US006442870B1

(12) United States Patent
Tsai

(10) Patent No.: US 6,442,870 B1
(45) Date of Patent: Sep. 3, 2002

(54) SHOE WITH REPLACEABLE VAMP AND INSOLE

(76) Inventor: Mao-Cheng Tsai, No. 190-12, Sec. 2, Chang-Ping Rd., Taichung (TW)

( * ) Notice: Subject to any disclaimer, the term of this patent is extended or adjusted under 35 U.S.C. 154(b) by 23 days.

(21) Appl. No.: 09/963,553

(22) Filed: Sep. 27, 2001

(51) Int. Cl.[7] ..... A43B 3/12; A43B 23/20; A43B 3/24

(52) U.S. Cl. ..... 36/11.5; 36/100; 36/101; 36/15; 36/24

(58) Field of Search ..... 36/101, 100, 11.5, 36/15, 23, 43, 44, 24; 24/640, 641, 591.1, 593.11, 594.1, 594.11, 596.1

(56) References Cited

U.S. PATENT DOCUMENTS 3,538,628 A * 11/1970 Einstein, Jr. ..... 36/100
3,742,625 A * 7/1973 Famolare, Jr. ..... 36/11.5
3,890,725 A * 6/1975 Lea et al. ..... 36/11.5
4,175,096 A * 11/1979 Reitz et al. ..... 564/82
4,420,894 A * 12/1983 Glassman ..... 36/107
5,317,822 A * 6/1994 Johnson ..... 36/101
5,339,543 A * 8/1994 Lin ..... 36/100
5,551,589 A * 9/1996 Nakamura ..... 220/326
5,822,888 A * 10/1998 Terry ..... 36/100
5,896,684 A * 4/1999 Lin ..... 36/101
6,349,486 B1 * 2/2002 Lin ..... 36/101

* cited by examiner

*Primary Examiner*—Anthony Stashick
(74) *Attorney, Agent, or Firm*—Bacon & Thomas, PLLC

(57) ABSTRACT

A shoe with replaceable vamp and insole consists of an outsole, an insole, a vamp and a plurality of anchor blocks. The outsole and insole have respectively anchor bores and anchor struts to attain replacement function. The outsole has housing chambers for holding the anchor blocks and a storing chamber for storing a dismantle tool. The anchor block has a wedge trough to engage with a latch section of the vamp to allow the vamp be replaced as desired.

6 Claims, 10 Drawing Sheets

SHOE WITH REPLACEABLE VAMP AND INSOLE

FIELD OF THE INVENTION

The present invention relates to an improved shoe and particularly a shoe that has a replaceable vamp and insole.

BACKGROUND OF THE INVENTION

A conventional shoe, such as the one shown in FIG. 1, generally has a vamp made by stitching, then the vamp and insole are glued and bonded together, then the vamp and the outsole are glued and compressed to complete the fabrication of the shoe. The shoe made by gluing and compressing lacks strong bonding power and tensile resistance. The vamp and insole and outsole are prone to separate and fall apart.

Moreover, the shoe with the vamp and insole and outsole fixedly bonded by gluing cannot be replaced by individual parts. They have limited practicality and interchange capability.

SUMMARY OF THE INVENTION

In view of aforesaid disadvantages, it is therefore a primary object of the invention to provide a shoe that has anchor struts and anchor bores formed respectively on the lower surface of the insole and upper surface of the outsole to allow the insole and outsole assembling and dismantling freely as desired.

Another object of the invention is to provide a plurality of housing chambers on the upper surface of the outsole for holding anchor blocks to facilitate assembly and disassembly of the vamp.

A further object of the invention is to provide various types of anchor blocks to fasten the vamp.

To attain the foregoing object, the shoe according to the invention mainly includes an outsole, an insole, a vamp and a plurality of anchor blocks. The outsole and insole are fastened through anchor bores and anchor struts to allow the insole be detached and replaced. The outsole has a plurality of housing chambers and a storing chamber for holding respectively anchor blocks and a dismantle tool. The anchor block has a wedge trough to engage with the latch section of the vamp to allow the vamp be removed and replaced whenever desired.

The foregoing, as well as additional objects, features and advantages of the invention will be more readily apparent from the following detailed description, which proceeds with reference to the accompanying drawings.

DESCRIPTION OF THE PREFERRED EMBODIMENTS

Figure 1:
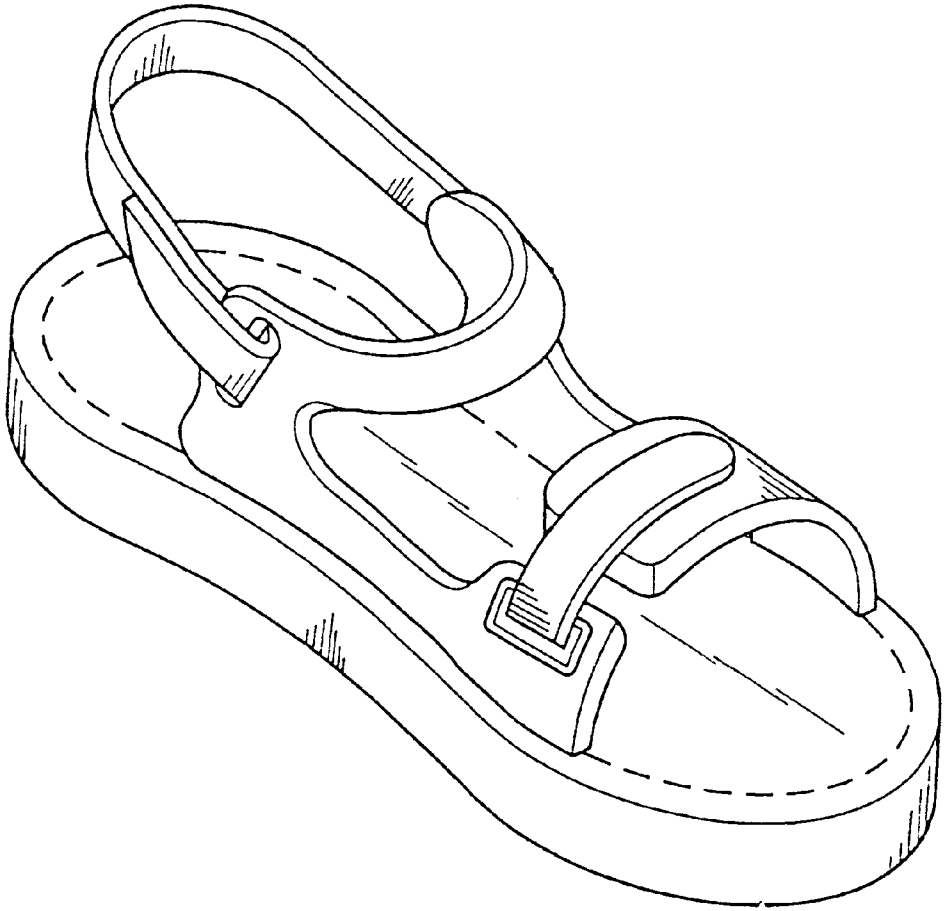
PRIOR ART FIG. 1
FIG. 1 is a perspective view of a conventional shoe.
Figure 2:
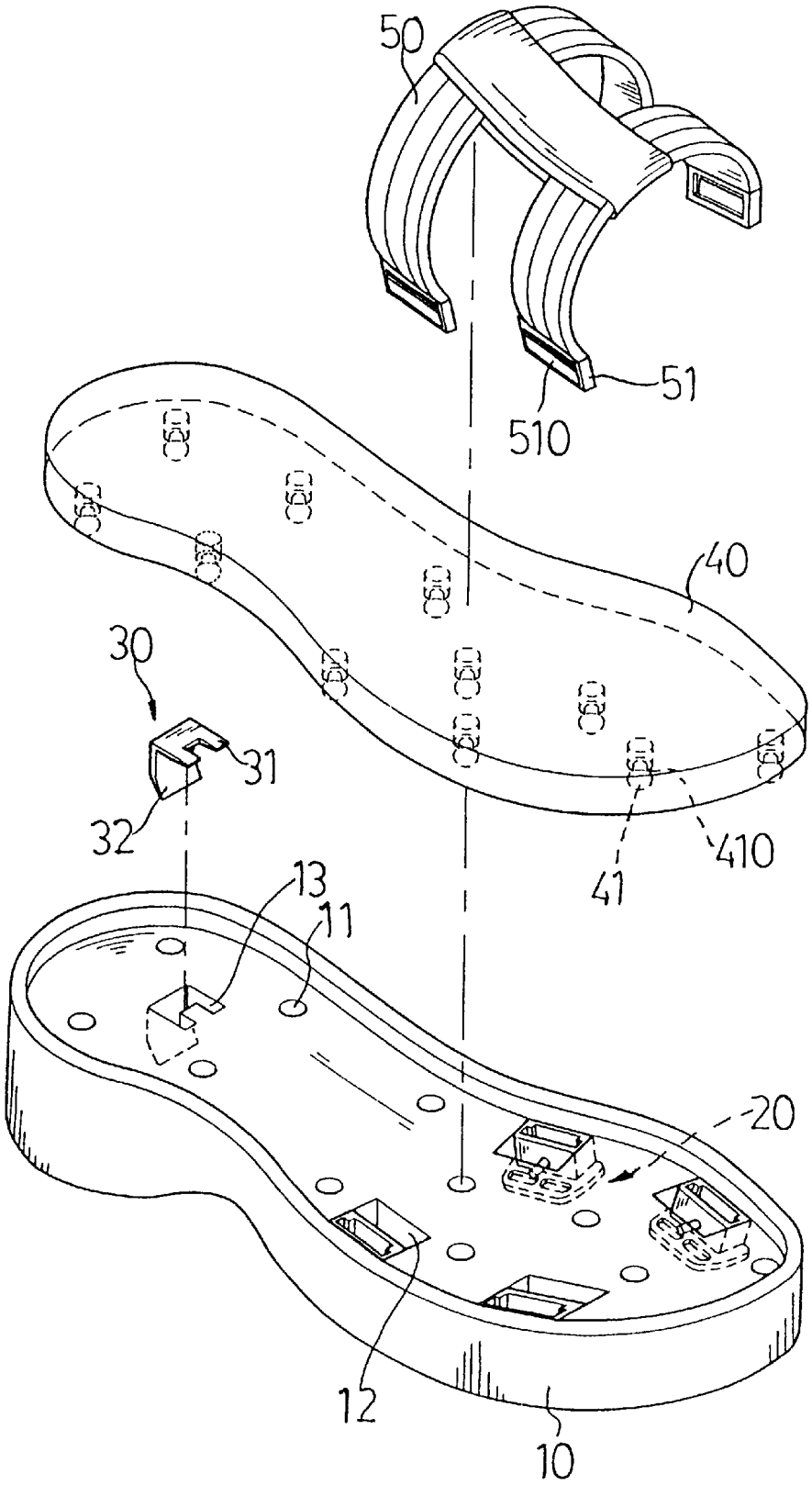
FIG. 2 is an exploded view of the invention.
Figure 3:
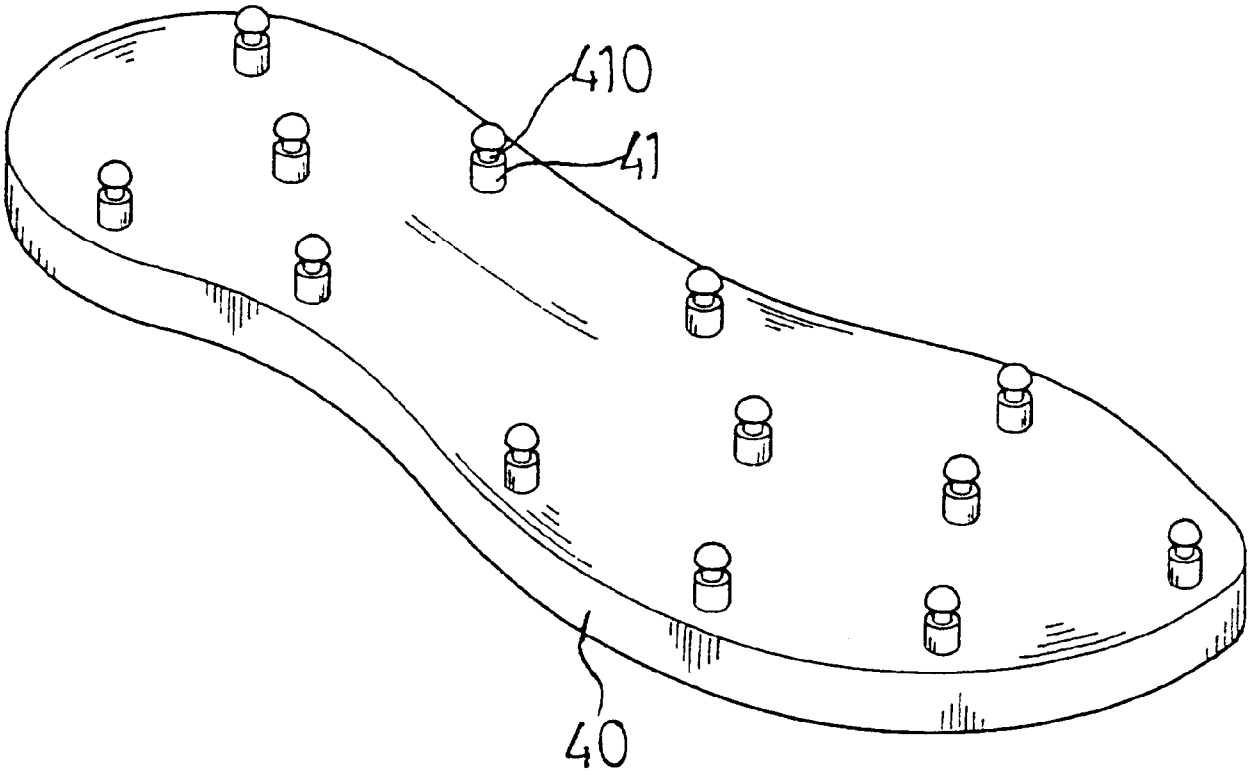
FIG. 3 is a perspective view of an insole of the invention.
Figure 4:
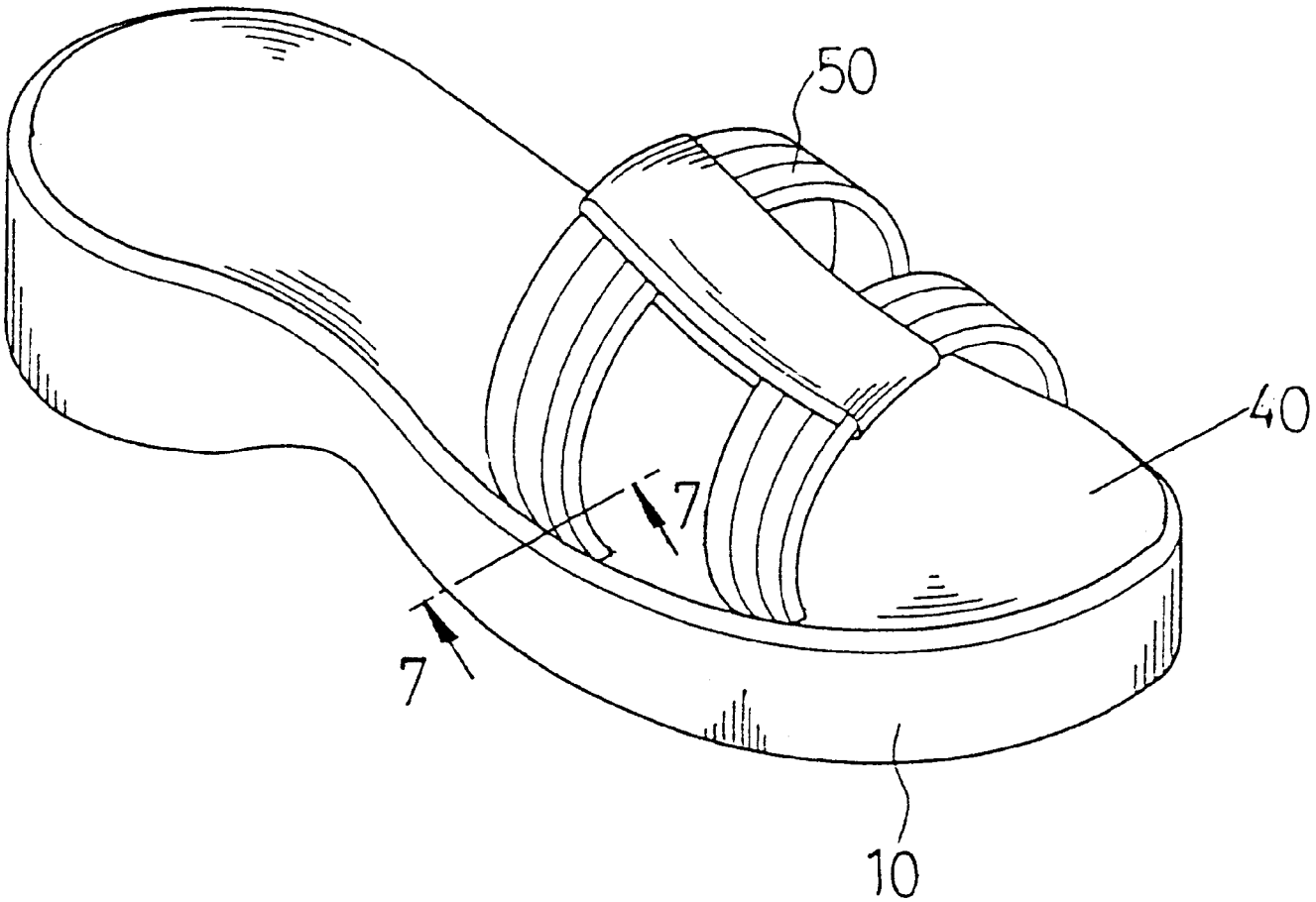
FIG. 4 is a perspective view of the invention.
Figure 5:
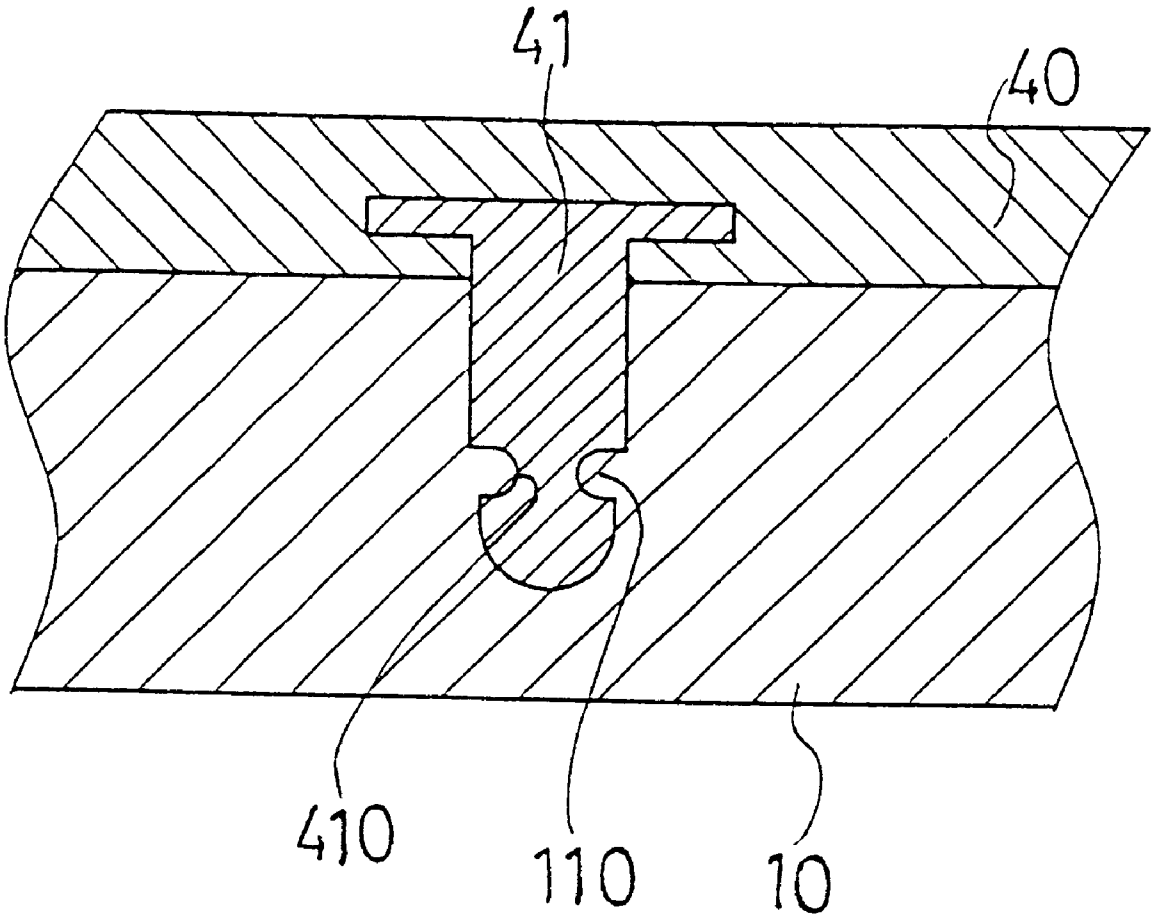
FIG. 5 is a fragmentary cross section of an anchor strut engaging with an anchor bore.
Figure 6:
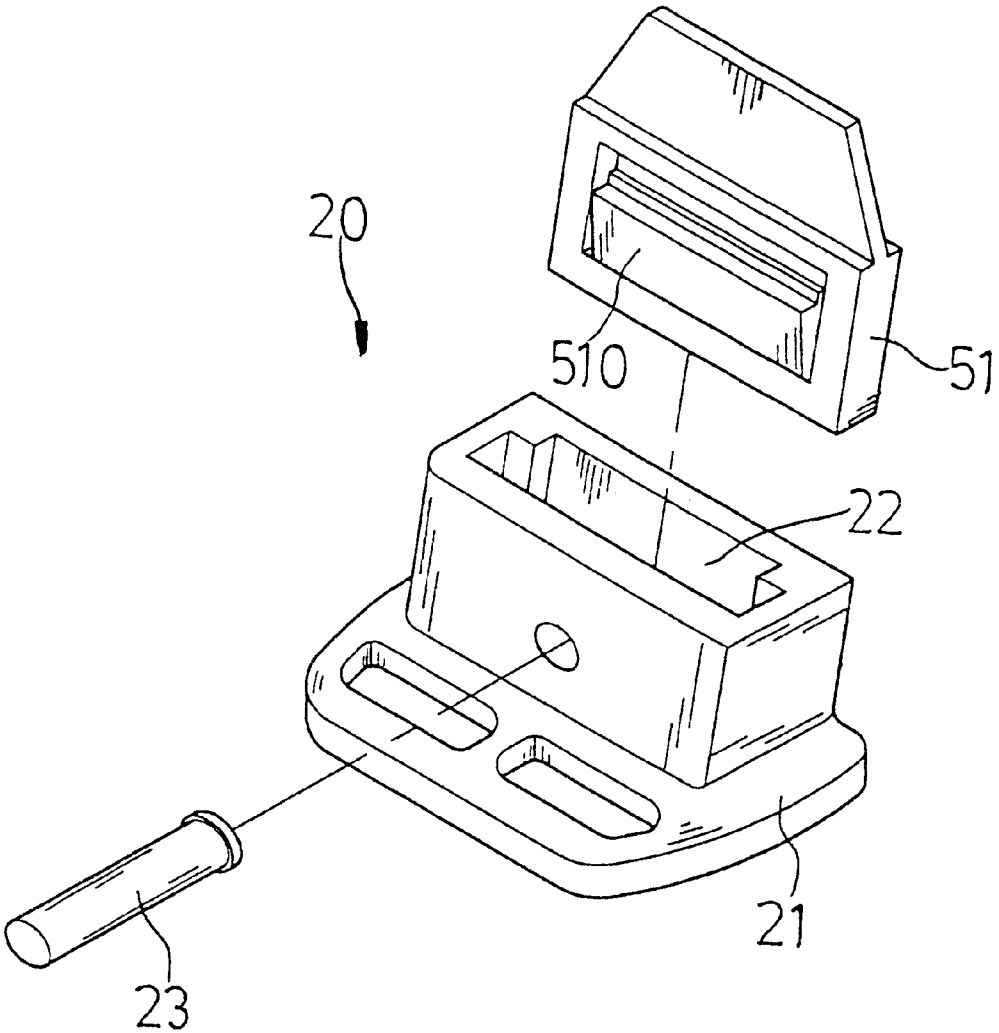
FIG. 6 is an exploded view of an anchor block.

Referring to FIGS. 2 through 9, the shoe according to the invention mainly consists of the following elements:

- an outsole 10 which has a plurality of anchor bores 11, a plurality of housing chambers 12 and a storing chamber 13 formed on the upper surface. Each anchor bore 11 has an annular jutting ring 110 (as shown in FIG. 5). The housing chamber 12 may hold and engage with an anchor block 20. The storing chamber 13 is to house a dismantle tool 30 which is formed substantially in an inverse Y-shape with an upper pry section 31 and a lower pry section 32;
- an insole 40 mounted to the upper surface of the outsole 10 includes a plurality of anchor struts 41 located on the lower surface mating the anchor bores 11 of the outsole 10. Each anchor strut 41 has an annular indented groove 410 mating and engageable with the annular jutting ring 110 of the anchor bore 11 (as shown in FIG. 5);
- a vamp 50 fastenable to the outsole 10 has latch sections 51 located at the ends thereof. Each latch section 51 has an extensible section 510; and
- a plurality of anchor blocks 20 each has a flange 21 to engage with the outsole 10 and to conceal securely in the housing chamber 12. The anchor block 20 further has a wedge trough 22 and a push pin 23. The wedge trough 22 has a retain edge 220 (as shown in FIG. 7).

Figure 7:
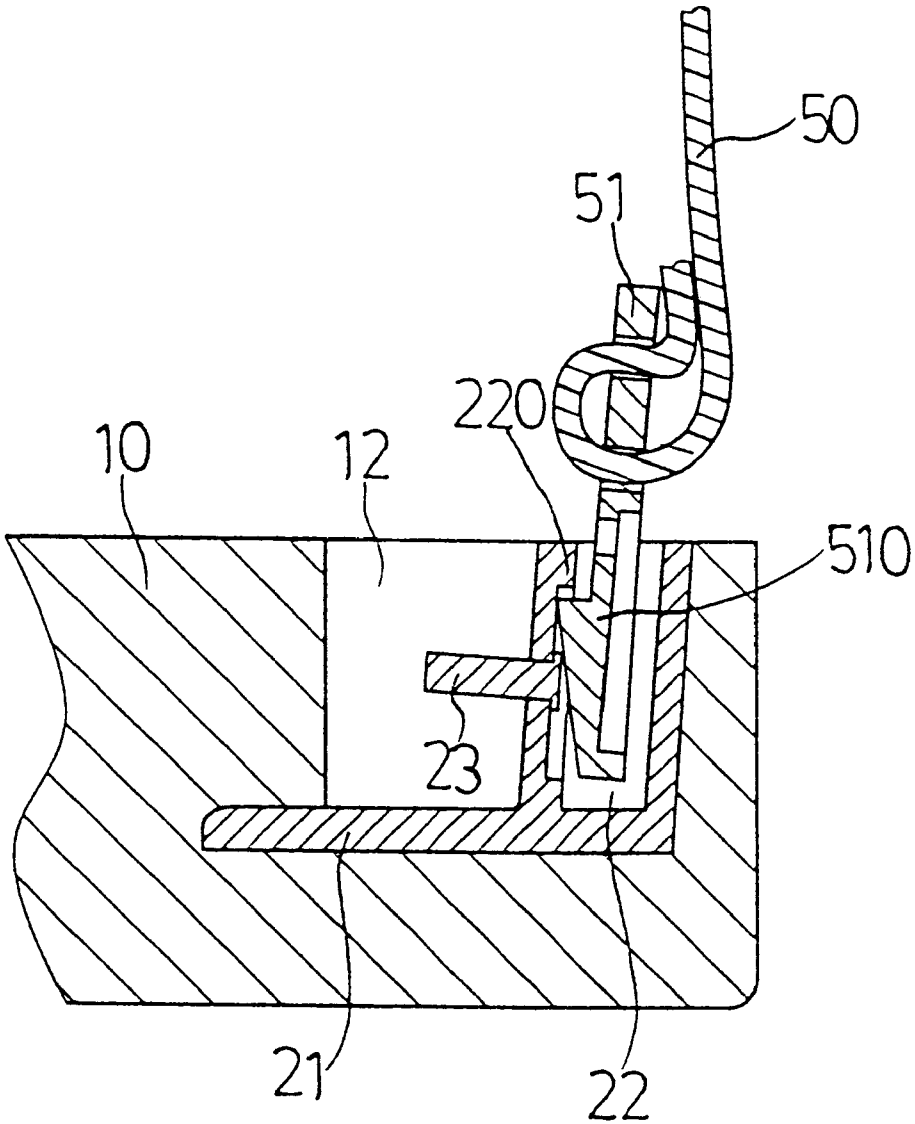
FIG. 7 is a cross section taken along line 7—7 in FIG. 4.

When to assemble the invention, insert the latch section 51 of the vamp 50 into the wedge trough 22 of the anchor block 22 with the extensible section 510 of the latch section 51 latching to the retain edge 220 (as shown in FIG. 7) to allow the vamp 50 fastening securely to the peripheral edge of the outsole 10.

Then dispose the anchor blocks 20 into the housing chambers 12 and the dismantle tool 30 into the storing chamber 13. Then wedge the anchor struts 41 of the insole 40 into the anchor bores 11 of the outsole 10 with the annular indented groove 410 engaging with the annular jutting ring 110 (as shown in FIG. 5) to allow the insole 40 fastening to the outsole 10.

When to disassemble, pull the insole 40 slightly upwards to detach the anchor struts 41 from the anchor bores 11 for separating the insole 40 from the outsole 10. Then replace the insole 40 of different materials or styles or colors as desired.

Figure 7A:
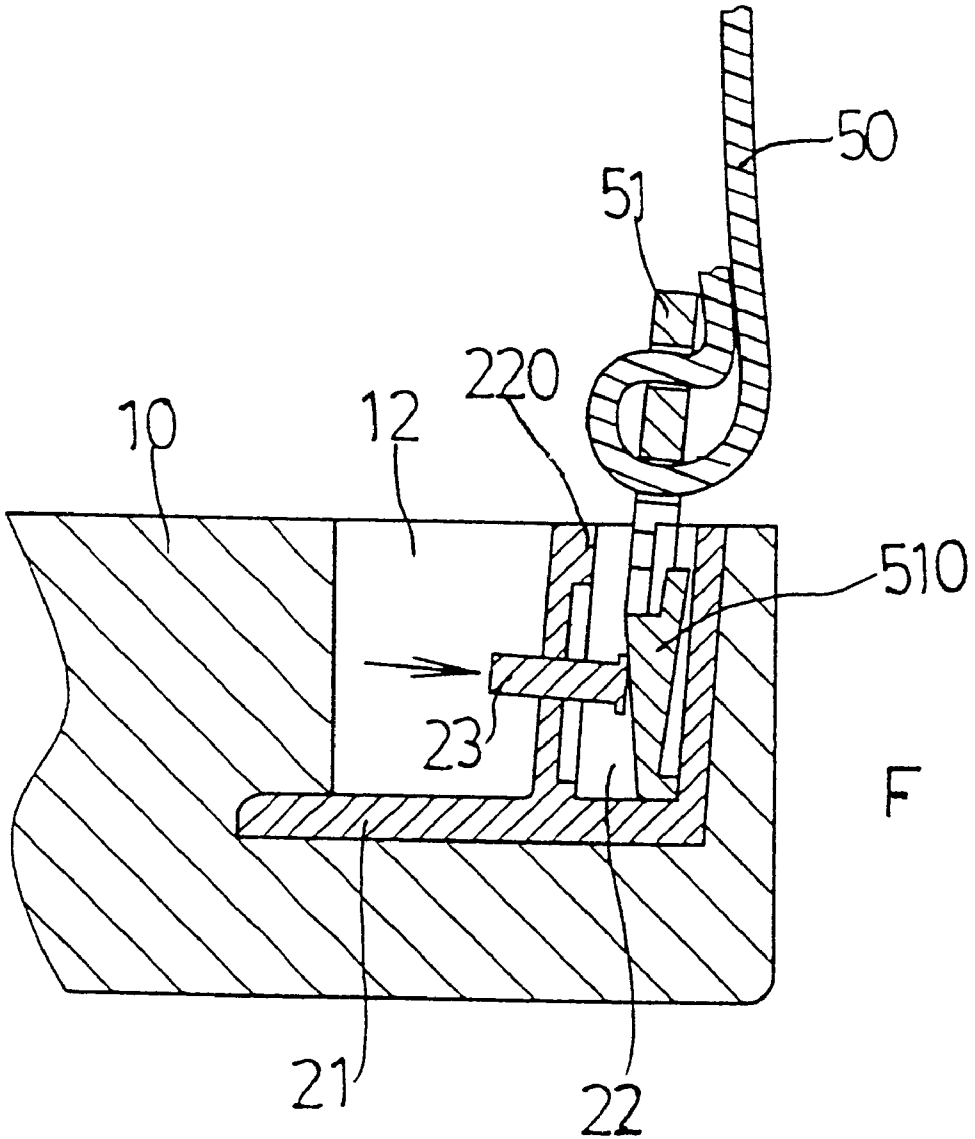
FIG. 7A is a cross section according to FIG. 7, showing the vamp under removing.

When the anchor block 20 is held in the housing chamber 12, there is extra space in the housing chamber 12 to receive users' finger for depressing the push pin 23 towards the latch section 51 to separate the extensible section 510 from the retain edge 220, then the latch section 51 may be removed from the wedge trough 22 (as shown in FIG. 7A), and the vamp 50 may be separated from the outsole 10 for replacing the vamp 50 of different materials or styles or colors.

By means of the construction and method set forth above, the vamp and insole may be changed and replaced freely as desired.

Figure 8:
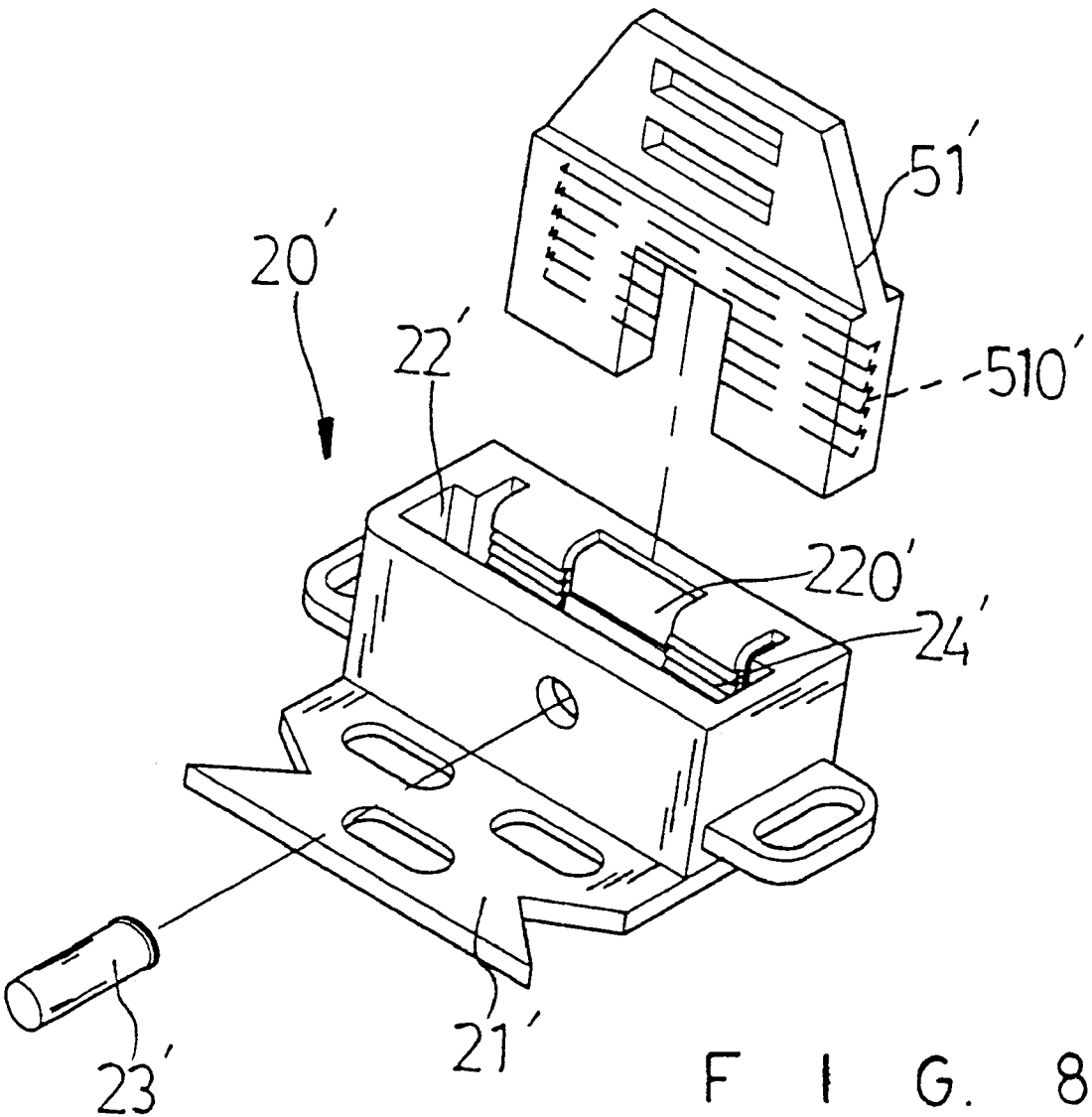
FIG. 8 is an exploded view of another embodiment of the anchor block.

FIG. 8 shows another embodiment of the invention with a different anchor block 20' and latch section 51' from the previous embodiment. The anchor block 20' also has a flange 21' to engage with the outsole (not shown in the drawing) and conceal securely in the housing chamber (not shown in the drawing) of the outsole. The anchor block 20' also has a wedge trough 22' and push pin 23' and an elastic retain section 220'. The elastic retain section 220' has a plurality of first latch teeth 24' formed on the exterior surface to match and engage with a plurality of second latch teeth 510' formed on the inner surface of the latch section 51'. When to disengage the latch section 51' from the elastic retain section 220', depress the push pin 23' against the elastic retain section 220', the latch section 51' may be disengaged from the elastic retain section 220' for moving the vamp 50 away.

The dismantle tool 30 may be stored in the storing chamber (not shown in the drawing) of the outsole (also not shown in the drawing). The upper pry section 31 may be wedged between the elastic retain section 220' and the latch section 51' to depress the elastic retain section 220' inwards, the latch section 51' may be disengaged from the elastic retain section 220' easily.

Figure 9:
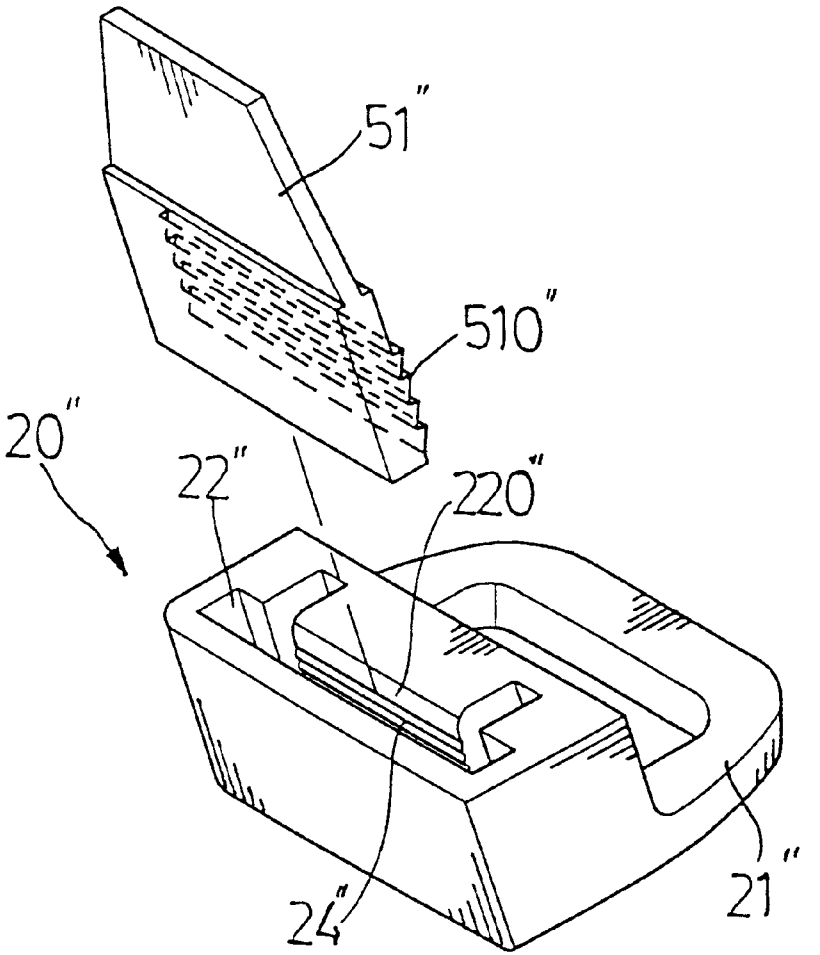
FIG. 9 is an exploded view of yet another embodiment of the anchor block.

FIG. 9 shows yet another embodiment of the invention. The anchor block 20" also has a flange 21" to engage with the outsole (not shown in the drawing) and conceal securely in the housing chamber (not shown in the drawing) of the outsole. The anchor block 20" also has a wedge trough 22" and an elastic retain section 220". The elastic retain section 220" has a plurality of first latch teeth 24" formed on the exterior surface to match and engage with a plurality of second latch teeth 510" formed on the inner surface of the latch section 51". When to disengage the latch section 51" from the elastic retain section 220', wedge the lower pry section 32 of the dismantle tool 30 between the elastic retain section 220" and the latch section 51" and depress the elastic retain section 220" inwards, the latch section 51" may be disengaged from the elastic retain section 220" easily.

By means of any of the anchor blocks 20, 20' and 20" set forth above, the vamp 50, 50' and 50" may be changed and replaced as desired.

What is claimed is:

1. A shoe with replaceable vamp and insole, comprising:

an outsole having a plurality of anchor bores, a plurality of housing chambers and a storing chamber formed on an upper surface thereof, each of the housing chambers holding an anchor block, the storing chamber holding a dismantle tool;

an insole fastened to the outsole having a plurality of anchor struts located on a lower surface thereof mating the anchor bores of the outsole; and a vamp fastened to the outsole having latch sections located at ends thereof, each latch section having an extensible section.

2. The shoe with replaceable vamp and insole of claim 1, wherein the anchor block has a flange to engage with the outsole, a wedge trough and a push pin, the wedge trough having a retain edge formed therein.

3. The shoe with replaceable vamp and insole of claim 1, wherein the dismantle tool has an upper pry section and lower pry section.

4. The shoe with replaceable vamp and insole of claim 1, wherein the anchor strut and the anchor bore have respectively an annular indented groove and an annular jutting ring formed thereon.

5. The shoe with replaceable vamp and insole of claim 1, wherein the housing chamber contains an anchor block to engage with the latch section of the vamp, the anchor block having a flange, a wedge trough and a push pin, the wedge trough having an elastic retain section, the elastic retain section having a plurality of first latch teeth formed on the exterior surface thereof to match and engage with a plurality of second latch teeth formed on the latch section.

6. The shoe with replaceable vamp and insole of claim 1, wherein the housing chamber contains an anchor block to engage with the latch section of the vamp, the anchor block having a flange and a wedge trough, the wedge trough having an elastic retain section, the elastic retain section and the latch section having respectively a plurality of first latch teeth and second latch teeth formed thereon to match and engage with each other.

* * * * *